United States Patent [19]

Trenschel et al.

[11] 4,344,740

[45] Aug. 17, 1982

[54] ROTOR ASSEMBLY

[75] Inventors: Donald R. Trenschel, Lake Park; Wilho V. Aho, Jr., West Palm Beach, both of Fla.

[73] Assignee: United Technologies Corporation, Hartford, Conn.

[21] Appl. No.: 79,915

[22] Filed: Sep. 28, 1979

[51] Int. Cl.[3] ..... F01D 5/30

[52] U.S. Cl. ..... 416/221; 416/193 A

[58] Field of Search ..... 416/220, 221

[56] References Cited

U.S. PATENT DOCUMENTS

| | | | |
|---|---|---|---|
| 2,925,997 | 2/1960 | Hart et al. | 416/220 |
| 2,985,426 | 5/1961 | Hunter et al. | 416/220 |
| 2,998,959 | 9/1961 | Haworth et al. | 416/221 |
| 3,023,998 | 3/1962 | Sanderson | 416/220 |
| 3,077,811 | 2/1963 | Moore | 416/220 |
| 3,656,865 | 4/1972 | Spears | 416/221 |
| 3,689,177 | 9/1972 | Klasson | 416/220 |
| 3,734,646 | 5/1973 | Perkins | 416/220 |
| 3,888,601 | 6/1975 | Glassburn | 416/220 R |

FOREIGN PATENT DOCUMENTS

| | | | |
|---|---|---|---|
| 960069 | 4/1950 | France | 416/218 |
| 905582 | 9/1962 | United Kingdom | 416/220 |

*Primary Examiner*—William L. Freeh

*Attorney, Agent, or Firm*—Robert C. Walker

[57] ABSTRACT

The present invention provides an improved sideplate of the type adhered to the side of a rotor disk for the retention of rotor blades and for blocking the leakage of working medium gases across the rotor disk. The elimination of retaining bolts and rivets is sought.

In one effective embodiment of the present invention, the sideplate is adhered to the disk at a bayonet type joint. The sideplate is elastically deformable to enable assembly of the sideplate onto the disk with abutting surfaces of the disk and sideplate in interference engagement at release. The side surface of the disk is tapered in cross section geometry to accommodate deformation of the sideplate.

4 Claims, 6 Drawing Figures

FIG. 1
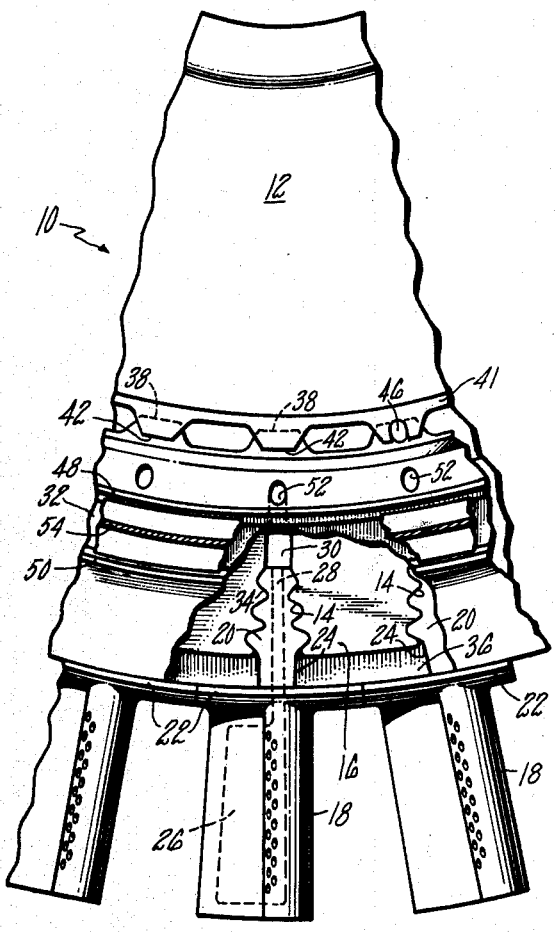
FIG. 2
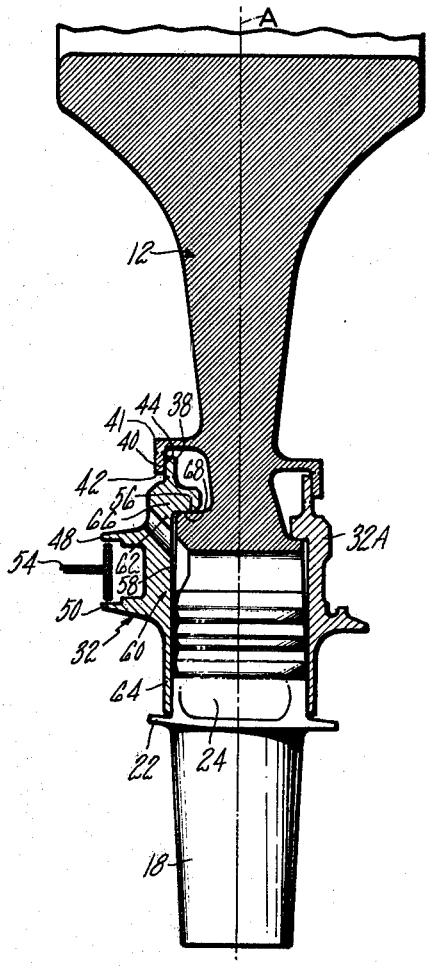
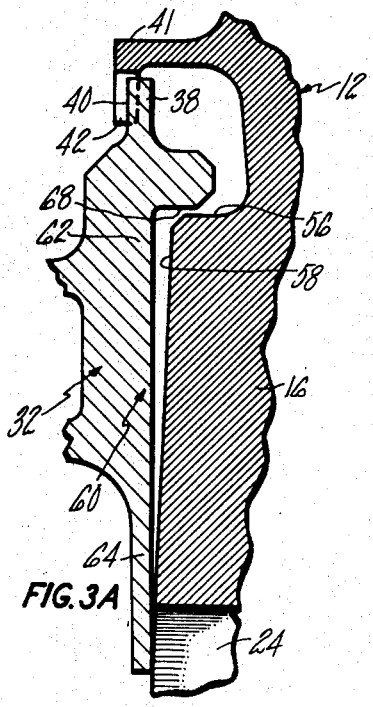
FIG. 3A
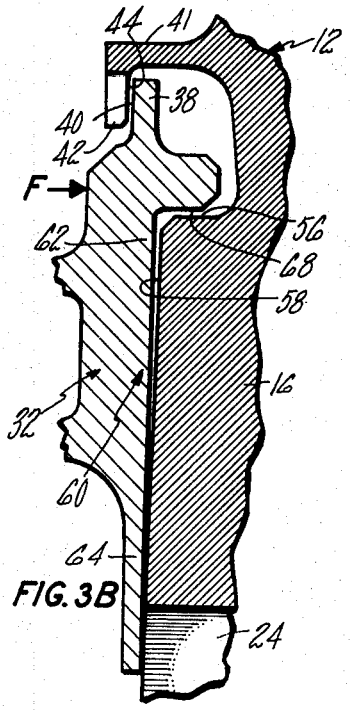
FIG. 3B
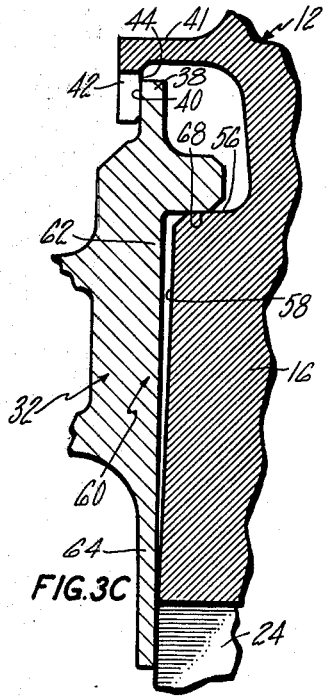
FIG. 3C

ROTOR ASSEMBLY

The Government has rights in this invention pursuant to Contract No. N00019-78-C-0123 awarded by the Department of the Navy.

TECHNICAL FIELD

This invention relates to rotary machines, and more specifically to sideplates of bladed rotor assemblies.

The concepts were developed in the gas turbine engine field for particular use in the turbine sections of such engines, but have wider applicability to other types of rotary machines.

BACKGROUND ART

Representative turbine constructions employing sideplates of the general type taught herein are illustrated in U.S. Pat. No. 3,096,074 to Pratt et al. entitled "Bladed Rotors of Machines Such as Gas Turbines" and U.S. Pat. No. 4,019,833 to Gale entitled "Means for Retaining Blades to a Disc or Like Structure". In such structures a plurality of rotor blades extend outwardly from a supporting disk across a flowpath for working medium gases. Each blade has a root section which engages the supporting disk at an essentially axial slot of complex geometry. A slight gap at the interface between the root section of the blade and the disk is provided to enable assembly of the blade into the disk slot. Under centrifugal forces in an operating machine the blade is urged outward within the slot to a point of restraint. Undesirably, the gap at the interface becomes large enough to induce the leakage of medium gases therethrough with a resultant degradation of engine performance. Disk sideplates are conventionally provided to cover the interfaces between the blades and the disk for the prevention of such leakage. The sideplates perform the additional function of axially retaining the root sections of the blades in the corresponding slots.

In structures of both the Pratt et al and Gale patents, one-piece sideplates are employed. Various interlocking tabs hold the sideplates against the rotor disk. Notwithstanding the availability of structures of the above type, improvements to sideplates and corresponding attaching structures are continually sought.

DISCLOSURE OF THE INVENTION

According to the present invention a one-piece sideplate of a rotor assembly has a plurality of lugs extending into axial interference engagement with a corresponding plurality of disk lugs to hold the sideplate securely against the disk without resort to conventional through bolts or rivets.

A primary feature of the invention is the root covering portion of the sideplate which is elastically deformable against the rotor disk to enable relative rotation of the sideplate with respect to the disk lugs at assembly. Each of the disk lugs has a surface which faces axially toward the centerplane of the disk. Each of the sideplate lugs has an outwardly facing surface which is rotatably alignable with the surface of the corresponding disk lug. In the assembled structure the opposing surfaces of the sideplate and disk lugs are in interference engagement. In at least one embodiment one or more pins penetrate the disk and sideplate lugs to preclude relative rotation of the disk and sideplate in the fully assembled condition. In other embodiments of the invention a locking ring engages the disk lugs to preclude relative rotation of the disk and sideplate. The outward region of the cover portion of the sideplate in the assembly contacts the corresponding side wall of the disk. The inward region of the cover portion of the sideplate in the assembly is spaced apart from the side wall of the disk. In at least one embodiment the corresponding side wall of the disk is inwardly tapered to provide the required spacing between the disk and the inward region of the cover portion of the sideplate.

A principal advantage of rotor assemblies constructed in accordance with the present invention is the avoidance of bolts or rivets attaching the sideplates to the disk. The sideplate is held securely against the side wall of the disk by the interference engagement of the disk and sideplate lugs. Spacing the inner region of the sideplate cover portion from the side wall of the rotor disk enables deformation of the sideplate and relative rotation thereof with respect to the disk lugs at assembly. Deformation of the cover portion of the sideplate at assembly is within the elastic limit of the sideplate material, such that the axial surfaces of the disk lug and the corresponding sideplate lug dispose in interference engagement upon the release of the installation pressure on the sideplate.

The foregoing, and other features and advantages of the present invention, will become more apparent in the light of the following description and accompanying drawing.

BRIEF DESCRIPTION OF THE DRAWING

FIG. 1 is a simplified front view of a portion of a rotor assembly with local regions of a blade covering sideplate broken away to reveal attachment of the rotor blades to the rotor disk;

FIG. 2 is a cross section view taken through the rotor assembly showing an installed sideplate in position against the rotor disk;

FIGS. 3A, 3B and 3C illustrate in simplified schematic form the steps of assembly of the sideplate onto the rotor disk.

DETAILED DESCRIPTION

Figure 4:
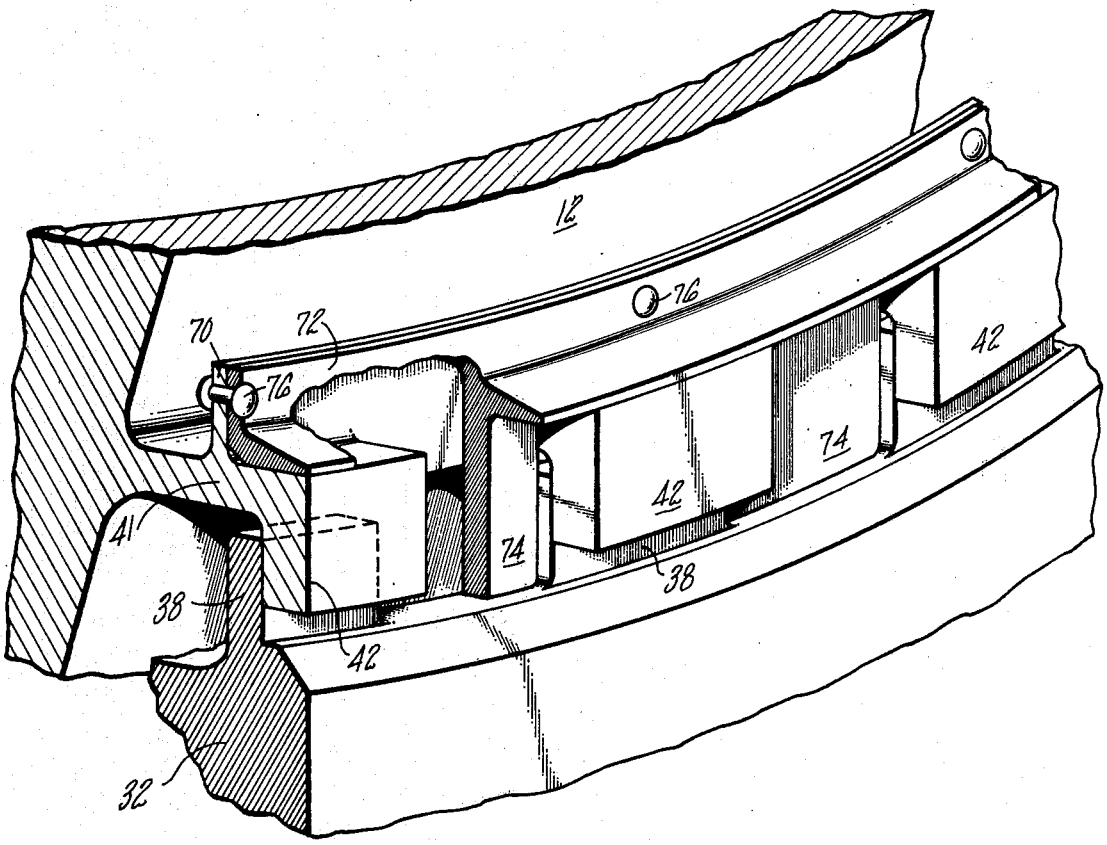
FIG. 4 is a simplified perspective view of a portion of the rotor assembly showing an alternative locking structure for precluding relative rotation of the sideplate and disk.

Apparatus constructed in accordance with the concepts of the present invention is known to have high utility in the turbine section of a gas turbine engine. The concepts are described with respect to such a turbine embodiment thereof although the concepts have wider applicability to rotary machines in general.

The FIG. 1 rotor assembly 10 is formed of a rotor disk 12 having a plurality of blade attachment slots 14 circumferentially spaced about the periphery 16 thereof. A plurality of rotor blades 18 corresponding in number to the number of attachment slots extend outwardly from the disk. Each blade has a root section 20 which engages a corresponding slot 14 and a platform section 22. As illustrated, the platform sections 22 are spaced outwardly from the periphery of the disk by extended neck regions 24 of the blades. In a turbine section the rotor blades are typically coolable and have hollow cavities 26 contained therein. Cooling air is supplied to the cavities by conduits 28 through the root and extended neck portions of the blades. A cooling air supply chamber 30 is formed at the base of each attachment slot between the blade root section and the disk.

A one-piece sideplate 32 covers the interfaces 34 between blade roots and the disk and covers the spaces 36 between adjacent blades beneath the blade platforms. The sideplate is spring-loaded against the disk at a bayonet type joint. Each sideplate has a plurality of inwardly extending lugs 38. Each lug has an axially facing surface 40. The disk has a laterally extending cylindrical arm 41 and a plurality of lugs 42 equal in number to the number of sideplate lugs extending outwardly from the arm. Each disk lug has an axially facing surface 44 which opposes the surface 40 of the corresponding sideplate lug. In the embodiment shown, locking means such as the pin or rivet 46, penetrates the disk and sideplate lugs to prevent relative rotation therebetween. Four (4) such pins are known to be adequate for most embodiments, although as will be explained later, some embodiments may not require such anti-rotation pins. Seal rings 48 and 50 extend laterally of the sideplate for cooperative sealing with adjacent components of the machine. The sideplate further includes holes 52 therein for the supply of cooling air to each of the chambers 30.

A portion of the rotor assembly is shown in cross section in FIG. 2. The disk 12, the sideplate 32 and one of the blades 18 are revealed. An annular component 54 of the engine stator assembly extends between the seal rings 48 and 50 of the rotor assembly. A similarly configured sideplate 32A is illustrated on the opposite side ofthe disk. The rotor disk has an axial centerplane A. The axially facing surfaces 44 of the lugs 42 face toward the centerplane. The disk further has a cylindrical surface 56 facing radially inwardly at a location inwardly of the attachment slots 14. A side surface 58 in cross section is tapered away from the centerplane of the disk at the periphery. Accordingly, the root covering portion 60 of the sideplate is spaced apart from the disk at the radially inner region 62 thereof. The radially outer region 64 abuts the tapered side surface of the disk and the rotor blade roots. Alternatively, the disk 12 may be provided with a circumferentially extending ridge on the side surface at the periphery to cause the inner region 62 of the sideplate to be spaced apart from the side surface of the disk, or the sideplate itself may be contoured to affect a corresponding geometry.

The sideplate 32 further has a ring portion 66 including a radially outwardly facing cylindrical surface 68. At installation the outwardly facing surface 68 of the sideplate and the inwardly facing surface 56 of the disk may be in interference or loose engagement. Radial restraining forces are exertable by the disk upon the sideplate at the surface 56. At installation the opposing surfaces of the disk 44 and the lugs 42 are in interference engagement, thus holding the sideplate axially against the disk without resort to bolts or rivets across the disk.

A technique for installing the sideplate 32 is enabled by the described structure and is illustrated in the schematic sequential views FIG. 3A, FIG. 3B and FIG. 3C. In the event an interference fit is desired, the sideplate 32 is radically cooled to reduce the diameter of the circumferential surface 68 to a diameter less than the diameter of the surface 56. The sideplate is placed against the disk as shown in FIG. 3A. A lateral force F is applied against the sideplate causing elastic deformation of the sideplate against the disk as in FIG. 3B. In this position, the disk lugs and sideplate lugs are free of engagement and the sideplate is rotatable to bring the surfaces 44 of the disk and the surfaces 40 of the sideplate into circumferential alignment. The force F is released and the sideplate is allowed to return to a temperature in equilibrium with that of the rotor disk. At equilibrium the circumferential surfaces 56 and 68 are in interference engagement and the axial surfaces 40 and 44 are in interference engagement.

In some embodiments it may be desired to add antirotation pins at the disk lugs. In other embodiments the friction of interference engagement between the sideplate and the disk may be sufficient to prevent rotation during operation of an engine in which the rotor assembly is installed. One further technique capable of precluding relative rotation is illustrated in the FIG. 4 perspective view of portions of the rotor disk 12 and sideplate 32. In this embodiment the arm 41 has an inwardly extending flange 70. A locking ring 72 having a plurality of lugs 74 is affixed to the flange 70 by attaching means such as the rivets 76. The lugs 74 of the locking ring interlock with the lugs 42 of the disk and the lugs 38 of the sideplate to prevent relative rotation of the components.

Although the invention has been shown and described with respect to detailed embodiments thereof, it should be understood by those skilled in the art that various changes and omissions in form and detail may be made therein without departing from the spirit and the scope of the invention.

We claim:

1. A rotor assembly comprising:

a rotor disk formed about an axial centerplane and having a plurality of attachment slots spaced circumferentially about the periphery of the rotor disk, a side wall in the region of the attachment slots which is tapered away from the centerplane at the periphery of the disk, a radially inwardly facing, cylindrical surface at a location radially inwardly of the side surface and of the attachment slots, a cylindrical arm extending laterally of the disk at a location inward of the inwardly facing cylindrical surface and having a plurality of radially outwardly extending lugs, each lug having an axial surface facing the centerplane;

a plurality of rotor blades equal in number to the number of attachment slots, one blade extending outwardly from each attachment slot and having a root in interlocking engagement with said slot; and a one-piece sideplate covering the engaged attachment slots and blade roots at one side of the disk, said sideplate having a ring portion including a radially outwardly facing, cylindrical surface in interference engagement with the inwardly facing, cylindrical surface of the disk, a plurality of circumferentially spaced lugs equal in number to the number of disk lugs and extending radially inwardly of the ring portion with each lug having an axially facing surface in interference engagement with the axially facing surface of the corresponding disk lug, and a cover portion having a disk opposing surface which is spaced apart at the radially inner region thereof from the corresponding, tapered side surface of the disk to enable deformation of the cover portion against the corresponding side surface at engagement of the coverplate lugs with the disk lugs.

2. The invention according to claim 1 wherein said locking means for preventing relative rotation comprises at least one pin which penetrates one of said disk lugs and the corresponding blade lug.

3. The invention according to claim 2 which further includes positive locking means for preventing relative rotation between the sideplate and the disk.

4. The invention according to claim 3 which further includes a locking ring fastened to said cylindrical arm which has a plurality of outwardly extending lugs adapted to extend between adjacent sideplate lugs to prevent said relative rotation between the sideplate and the disk.

* * * * *